US005317491A

United States Patent [19]

Lee

[11] Patent Number: 5,317,491

[45] Date of Patent: May 31, 1994

[54] HOLDER FOR STRING OF ELECTRIC LIGHTS

[76] Inventor: Kuo-Hsing Lee, 10139 Duchamp, Houston, Tex. 77036

[21] Appl. No.: 923,557

[22] Filed: Aug. 3, 1992

[51] Int. Cl.[5] ..... F21V 21/00

[52] U.S. Cl. ..... 362/249; 362/226; 206/420; 206/421

[58] Field of Search ..... 206/419, 420, 421; 362/249, 252, 806, 226

[56] References Cited

U.S. PATENT DOCUMENTS

| | | | |
|---|---|---|---|
| 2,984,347 | 5/1961 | Kalinchuk | 206/419 |
| 4,228,896 | 10/1980 | Wu | 206/420 |
| 4,971,200 | 11/1990 | Huang et al. | 362/249 |
| 5,123,534 | 6/1992 | Chwang | 206/419 |
| 5,168,999 | 12/1992 | Lee et al. | 206/420 |

FOREIGN PATENT DOCUMENTS

| | | | |
|---|---|---|---|
| 1051190 | 2/1959 | Fed. Rep. of Germany | 206/419 |

*Primary Examiner*—Richard R. Cole
*Assistant Examiner*—Alan B. Cariaso
*Attorney, Agent, or Firm*—Bill B. Berryhill

[57] ABSTRACT

A holder for a string of electric lights which includes a flat mounting plate on at least one side of which is provided first and second sets of mounting elements for mounting a series of lamps and lamp sockets of said string of electric lights in first and second rows at opposite ends of the mounting plate. Third and fourth sets of mounting elements may be provided on the opposite side of the plate. Each of the sets of mounting elements includes a row of uniformly spaced tabs between which are provided a row of uniformly spaced slots and a row of projecting pairs of elements providing another row of uniformly spaced slots therebetween.

11 Claims, 2 Drawing Sheets

HOLDER FOR STRING OF ELECTRIC LIGHTS

BACKGROUND OF THE INVENTION

1. Field of the Invention

The present invention pertains to holders for storing and/or displaying electric lights. More specifically, the present invention pertains to holders for storing and/or displaying strings of electric lights such as Christmas lights.

2. Brief Description of the Prior Art

Various kinds of electric lights are manufactured which include a plurality of lamps and corresponding lamp sockets connected at spaced intervals to electrical wiring. The lamps may be connected in series or parallel. Typical of such lights are the kind sold for Christmas or other holidays which allow a multiplicity of lights to be strung around a Christmas tree or other object as decoration.

Unless some container is provided for displaying or storing such lights, the wire and lamps may become entangled and when an attempt is made to untangle them there may be damage to the wiring, lamp sockets or lamps rendering the light string useless. For this reason, strings of electric lights are typically placed on a cardboard or plastic holder in some organized fashion and placed in a box for display or storage. The box may be provided with a window or opening so that the purchaser may view the type of lights he is purchasing. Such boxes are relatively bulky, easily damaged and not easy to reuse. Since they are relatively bulky, these boxes or containers require much more storage and display space than should be required.

Particularly with the increase in popularity of electric light strings having miniature lamps, prior art packaging and storage leave much to be desired. Continued developments in compact and efficient storage of such lights is needed.

SUMMARY OF THE PRESENT INVENTION

The present invention provides a holder for a string of electric lights, particularly suitable for those such as Christmas lights utilizing miniature lamps and lamp sockets. The holder includes a stiff flat mounting plate on at least one side of which is provided a first set of mounting elements for mounting a series of lamps and lamp sockets in a first row at one end of the plate and a second set of mounting elements for mounting a series of lamps and lamp sockets in a second row at the other end of the plate. Third and fourth sets of mounting elements substantially identical to the first and second sets of mounting elements may be provided on the opposite side of the flat mounting plate.

Each of the sets of mounting elements includes a row of uniformly spaced tabs between which are provided a row of uniformly spaced slots, each of the slots being for receiving one of the lamps near its junction with a corresponding one of the sockets. Each of the sets of mounting elements also includes a first row of projecting pairs of elements providing another row of uniformly spaced slots therebetween, each of these slots being for receiving wiring emanating from the base of a corresponding one of the sockets so that all of the sockets are confined between corresponding first projecting pairs of elements at one end and tabs at the other.

In preferred embodiments, each of the sets of mounting elements also include a second row of projecting pairs of elements between the row of tabs and the first row of projecting pairs of elements to provide still another row of uniformly faced spaced slots therebetween, each of these slots being for receiving an intermediate portion of corresponding ones of the sockets to aid in holding the sockets in the confined disposition between the first projecting pairs of elements and the tabs. Other features are provided to assist in neatly and efficiently holding the lamps, lamp sockets and associated wiring in such a manner as to provide neat and efficient storage for display and storage.

The holder of the present invention is particularly suited for storing and displaying a large number of small or miniature lamps, such as those used with popular Christmas tree light strings. The holder is conveniently designed for slipping in and out of a small rectangular box. It is designed for easy removal of the light string and easy and efficient return of the light string to the holder after use for permanent storage. Many other objects and advantages of the invention will be apparent from reading the description which follows in conjunction with the accompanying drawings.

DESCRIPTION OF A PREFERRED EMBODIMENT

Figure 1:
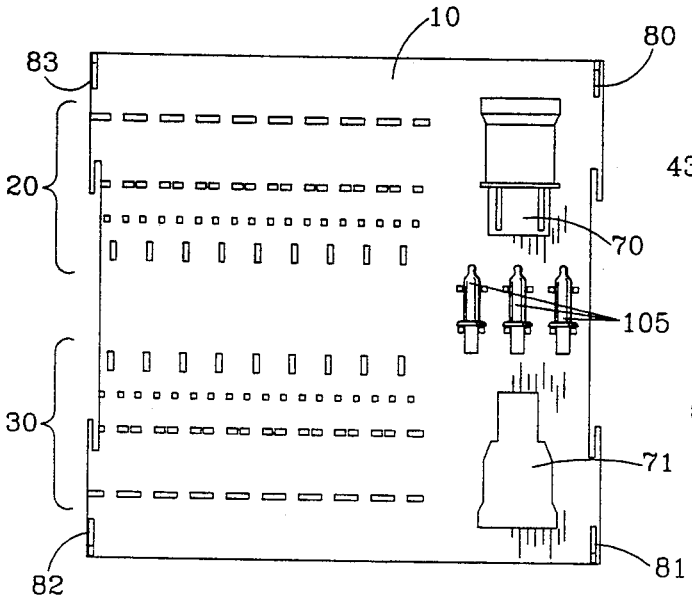
FIG. 1 is a plan view of one side of a holder for holding a string of electric lights, according to a preferred embodiment of the invention.
Figure 2:
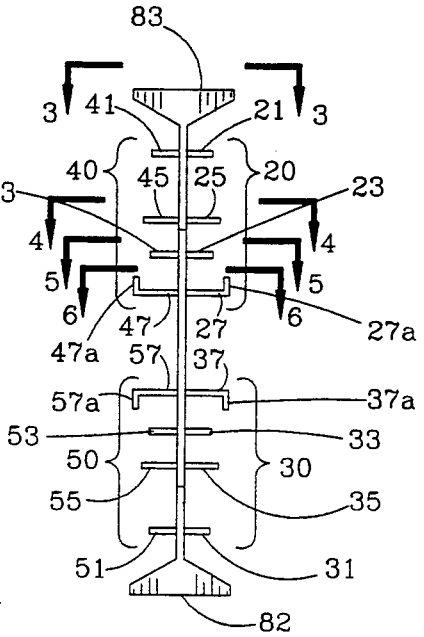
FIG. 2 is an side view of the light string holder of FIG. 1, according to a preferred embodiment thereof.
Figure 3:
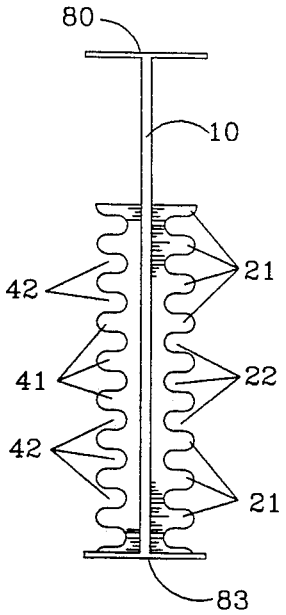
FIG. 3 is an end view of the holder of FIG'S. 1 and 2 as viewed from along lines 3–3 of FIG. 2.
Figure 7:
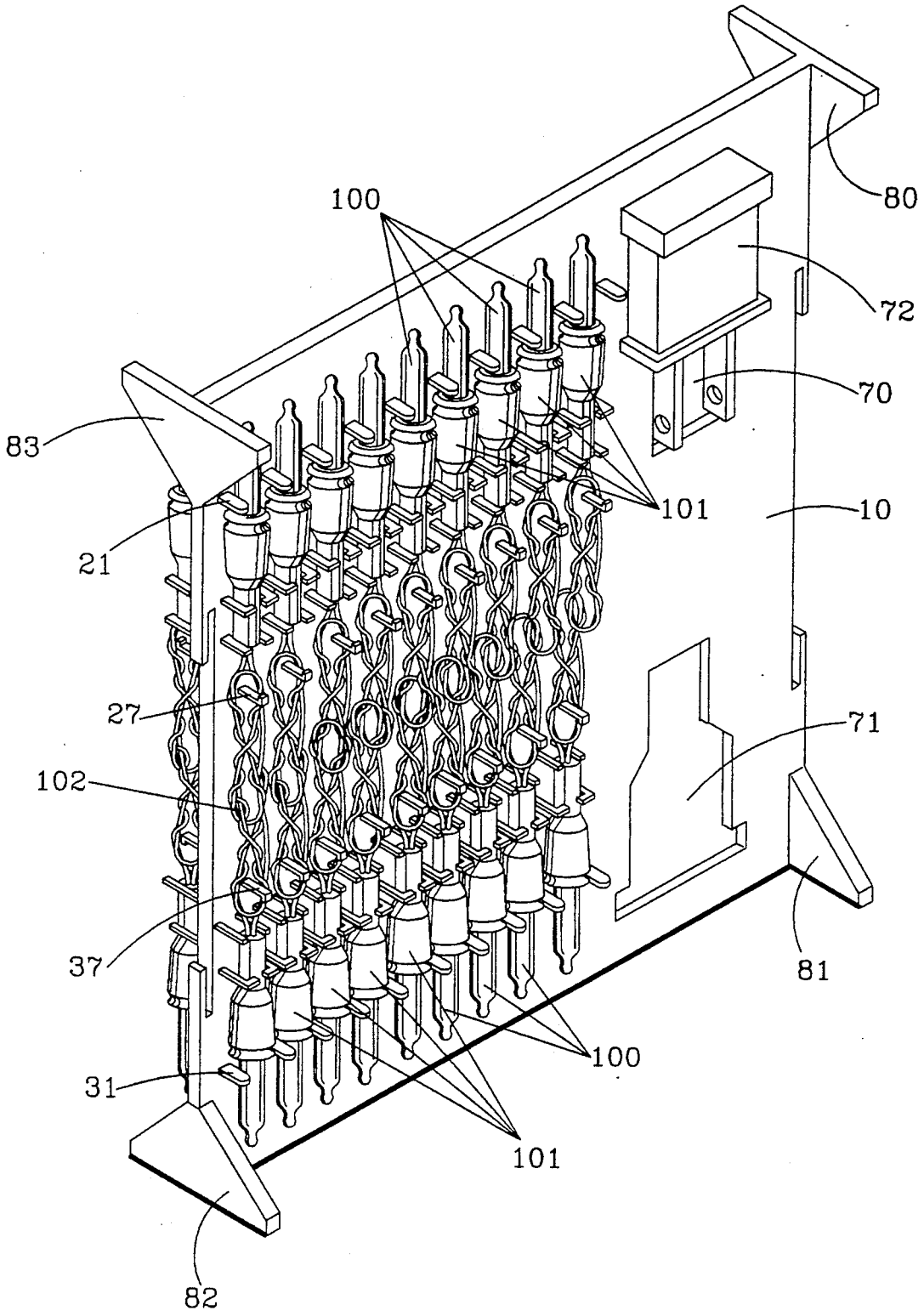
FIG. 7 is a perspective view of the holder of FIG'S. 1–6 showing a string of lights, with lamps, corresponding lamp sockets and associated electrical wiring, attached thereto for display and/or storage, according to a preferred embodiment thereof.

Referring first to FIG'S. 1 and 2, there is shown a holder for holding a string of electric lights (such as shown in FIG. 7) which includes a plurality of lamps 100 and corresponding lamp sockets 101 connected at spaced intervals to electrical wiring. The holder includes a stiff flat mounting plate 10 which in the exemplary embodiment is an essentially square plate preferably made of stiff plastic or the like. One side of the mounting plate 10 is provided with a first set of mounting elements 20 at one end of the plate 10 and a second set of mounting elements 30 at the opposite end thereof. Third and fourth sets of mounting elements 40 and 50 may be provided on the opposite side of the flat plate 10. Each of the sets of mounting elements includes a row of uniformly spaced tabs 21, 31, 41, 51 between which are provided a row of uniformly spaced slots 22, 32, 42, 52, etc. See also FIG. 3. Each of these slots 22, 32, 42, 52 is for receiving one of the lamps 100 near its junction with a corresponding one of the sockets 101, such as shown in FIG. 7.

Figure 5:
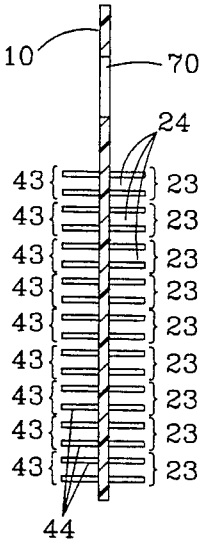
FIG. 5 is a cross-sectional view of the holder of FIG'S. 1 and 2 taken along lines 5—5 of FIG. 2.
Figure 6:
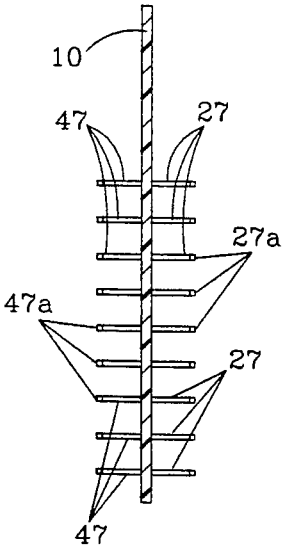
FIG. 6 is a cross-sectional view of the holder of FIG'S. 1 and 2, taken along lines 6—6 of FIG. 2.

Each of the sets of mounting elements 20, 30, 40, 50 also includes a first row of projecting pairs of elements 23, 33, 43, 53 (see also FIG. 5) providing another row of uniformly spaced slots 24, 34, 44, 54 therebetween each for receiving wiring such as the wiring 102 in FIG. 7 emanating from the base of corresponding ones of said lamp sockets 101 so that each one of said sockets 101 is confined between corresponding first projecting pairs of elements 23, 33, 43, 53 at one end thereof and corresponding tabs 21, 31, 41, 51 at the other end of said sockets 101.

Figure 4:
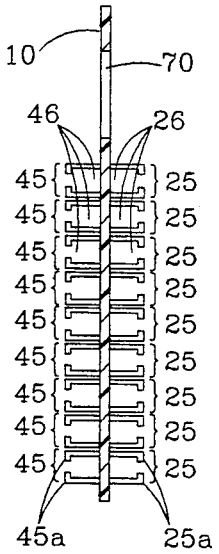
FIG. 4 is a cross-sectional view of the holder of FIG'S. 1 and 2, taken along lines 4—4 of FIG. 2.

In a preferred embodiment, the sets of mounting elements 20, 30, 40, 50 include a second row of projecting pairs of elements 25, 35, 45, 55 (see also FIG. 4) between said tabs 21, 31, 41, 51 and said first row of projecting pairs of elements 23, 33, 43, 53 to provide still another row of uniformly spaced slots 26, 36, 46, 56 therebetween. Each of these slots 26, 36, 46, 56 are provided for receiving intermediate portions of corresponding ones of the sockets 101 to aid in holding these sockets in the confined disposition between projecting pairs of elements 23, 33, 43, 53 and corresponding tabs 21, 31, 41, 51. The proximal ends of the second row of projecting pairs of elements 25, 35, 45, 55 are fixed to the flat plate 10. The distal ends thereof have mutually inwardly directed fingers 25*a*, 35*a*, 45*a*, 55*a* for preventing premature displacement of corresponding ones of the sockets 101 but are outwardly moveable, upon application of outwardly directed forces thereto, to permit placement and displacement of the corresponding ones of the sockets 101 into and from the confined disposition between the first projecting pairs of elements 23, 33, 43, 53 and the tabs 21, 31, 41, 51.

Each of the sets of mounting elements 20, 30, 40, 50 also includes a row of projecting pins 27, 37, 47, 57 adjacent the first row of projecting pairs of elements 23, 33, 43, 53 and about which the wire 102 connecting adjacent ones of the lamp sockets 101 may be looped, as shown in FIG. 7, for side by side disposition. The distal ends of these projecting pins 27, 37, 47, 57 may be provided with fingers 27*a*, 37*a*, 47*a*, 57*a* which extend toward the corresponding elements of the corresponding set of said mounting elements 20, 30, 40, 50.

The flat plate 10 may also be provided with one or more holes 70, for receiving at least one electrical plug 72 which may be attached to the wiring 102 for connecting the wiring 102 and its associated lamps 100 and lamp sockets 101 to a source of electrical power. A hole 71 may also be provided for receiving an end connector (not shown) by which another string of lights may be connected to the end of the first string of lights.

In addition, spacer members 80, 81, 82, 83 may extend upwardly from the corners of the flat plate 10, possibly on both sides thereof, to space the flat plate 10 and the sets of mounting elements 20, 30, 40, and 50 at predetermined positions from the sides of any box (not shown) in which the holder might be placed for sale and/or storage. This prevents interference with placement and removal of the holder and any lights placed thereon in and from such boxes.

Other features, such as mounting elements for retaining spare lamps 105 may be provided on one or both sides of the plate 10. In fact, although a single embodiment of the invention has been described herein, many variations may be made without departing from the spirit of the invention. Accordingly, it is intended that the scope of the invention be limited only by the claims which follow.

I claim:

1. A holder for a string of electric lights which includes a plurality of lamps engaging corresponding lamp sockets each one of which has a base connected at spaced intervals to electrical wiring, said holder comprising:

a stiff flat mounting plate on at least one side of which is provided a first set of mounting elements for mounting a series of lamps and lamp sockets in a first row at a first end of said plate and a second set of mounting elements for mounting a series of lamps and lamp sockets in a second row at a second end of said plate;

each of said first and second sets of mounting elements comprising a row of uniformly spaced tabs between which are provided a row of uniformly spaced slots each for receiving one of said lamps near a corresponding one of said sockets;

each of said first and second set of mounting elements comprising a first row of projecting pairs of elements providing another row of uniformly spaced slots therebetween each for receiving wiring emanating from the base of said corresponding one of said sockets so that said sockets are confined between said first projecting pairs of elements at one end thereof and said tabs at the other end thereof;

each of said first and second sets of mounting elements also including a second row of projecting pair of elements between said tabs and said first row of projecting pairs of elements providing still another row of uniformly spaced slots therebetween each for receiving an intermediate portion of said corresponding ones of said sockets to aid in holding said sockets in said confined disposition between said first projecting pairs of elements and said tabs.

2. A holder for a string of electric lights as set forth in claim 1 in which proximal ends of said second row of projecting pairs of elements are fixed to said flat plate, the distal ends of each pair of said elements having mutually inwardly directed fingers for preventing premature displacement of said corresponding ones of said sockets but being outwardly moveable upon application of outwardly directed force thereto to permit placement and displacement of said corresponding ones of said sockets into and from said confined disposition between said first projecting pairs of elements and said tabs.

3. A holder for a string of electric lights as set forth in claim 2 in which each of said first and second sets of mounting elements includes a row of projecting pins adjacent said first row of projecting pairs of elements about which wire connecting adjacent ones of said lamp sockets from one of said first and second sets of mounting elements may be looped for side by side disposition.

4. A holder for a string of electric lights as set forth in claim 3 in which the distal ends of said projecting pins are provided with fingers which extend toward the corresponding elements of the corresponding set of said mounting elements.

5. A holder for a string of electric lights which includes a plurality of lamps engaging corresponding lamp sockets each one of which has a base connected at spaced intervals to electrical wiring, said holder comprising:

a stiff flat mounting plate on at least one side of which is provided a first set of mounting elements for mounting a series of lamps and lamp sockets in a first row at a first end of said plate and a second set of mounting elements for mounting a series of lamps and lamp sockets in a second row at a second end of said plate;

each of said first and second sets of mounting elements comprising a row of uniformly spaced tabs between which are provided a row of uniformly spaced slots each for receiving one of said lamps near a corresponding one of said sockets;

each of said first and second set of mounting elements comprising a first row of projecting pairs of elements providing another row of uniformly spaced slots therebetween each for receiving wiring emanating from the base of said corresponding one of said sockets so that said sockets are confined between said first projecting paris of elements at one end thereof and said tabs at the other end thereof;

each of said first and second sets of mounting elements also including a row of projecting pins adjacent said first row of projecting pairs of elements about which wire connecting adjacent ones of said lamp sockets from one of said first and second sets of mounting elements may be looped for side by side disposition, the distal ends of said projecting pins being provided with fingers which extend toward corresponding elements of the corresponding set of said mounting elements.

6. A holder for a string of electric lights as set forth in claim 1 in which said flat plate has corner edges from which spacer members extend upwardly to space said flat plate and said first and second set of mounting elements at predetermined positions from the sides of any box in which said holder might be placed for sale and/or storage to prevent interference with placement and removal of said holder and said string of electric lights in and from said box.

7. A holder as set forth in claim 1 in which at least one hole is provided in said flat mounting plate to receive at least one electric plug which may be attached to said string of electrical lights for connecting said string of electrical lights to a source of electric power.

8. A holder for a string of electric lights as set forth in claim 1 in which third and fourth sets of mounting elements substantially identical to said first and second sets of mounting elements are provided on the opposite side of said flat mounting plate from said one side thereof.

9. A holder for a string of electric lights as set forth in claim 5 in which said flat plate has corner edges from which spacer members extend upwardly to space said flat plate and said first and second set of mounting elements at predetermined positions from the sides of any box in which said holder might be placed for sale and/or storage to prevent interference with placement and removal of said holder and said string of electric lights in and from said box.

10. A holder as set forth in claim 5 in which at least one hole is provided in said flat mounting plate to receive at least one electric plug which may be attached to said string of electrical lights for connecting said string of electrical lights to a source of electric power.

11. A holder for a string of electric lights as set forth in claim 5 in which third and fourth sets of mounting elements substantially identical to said first and second sets of mounting elements are provided on the opposite side of said first mounting plate from said one side thereof.

* * * * *